US006381878B1

(12) United States Patent
Kennedy, III et al.

(10) Patent No.: US 6,381,878 B1
(45) **Date of Patent: *May 7, 2002**

(54) COMPOSITE CLEAT FOR ATHLETIC SHOE

(75) Inventors: Thomas J. Kennedy, III, Wilbraham; Joel A. Singer, Quincy, both of MA (US)

(73) Assignee: Spalding Sports Worldwide, Inc., Chicopee, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/703,238

(22) Filed: Oct. 31, 2000

Related U.S. Application Data

(63) Continuation-in-part of application No. 09/235,581, filed on Jan. 22, 1999, now Pat. No. 6,138,386, which is a continuation-in-part of application No. 08/922,822, filed on Sep. 3, 1997, now Pat. No. 5,906,059.

(51) Int. Cl.[7] ..... A43B 23/28; A43C 15/00

(52) U.S. Cl. ..... 36/134; 36/127; 36/67 D; 36/67 R; 36/61

(58) Field of Search ..... 36/134, 67 D, 36/67 R, 61, 59 R, 59 C, 59 A, 127

(56) References Cited

U.S. PATENT DOCUMENTS

| | | | |
|---|---|---|---|
| 1,072,794 | A | 9/1913 | Tradesco |
| 1,350,839 | A | 8/1920 | Rendle |
| 1,796,399 | A | 3/1931 | Roodhouse |
| 1,870,751 | A | 8/1932 | Reach |
| 2,078,626 | A | 4/1937 | Bauer |
| 2,166,958 | A | 7/1939 | Lawson |
| 2,222,650 | A | 11/1940 | Brady |
| 2,223,794 | A | 12/1940 | Pierce et al. |
| 2,677,905 | A | 5/1954 | Dye |
| 3,043,026 | A | 7/1962 | Semon |
| D208,761 | S | 10/1967 | Gottlieb ..... D2/320 |

(List continued on next page.)

OTHER PUBLICATIONS

USA Today, Aug. 20, 1998, p. 8C.

*Primary Examiner*—Marie Patterson

(57) ABSTRACT

A composite, long wearing, slip-resistant non-metal golf cleat that alleviates damage to grass, e.g., the surface of a golf green, yet provides traction similar to conventional metal spikes is disclosed.

22 Claims, 7 Drawing Sheets

U.S. PATENT DOCUMENTS

| | | | | |
|---|---|---|---|---|
| 3,573,155 | A | | 3/1971 | Mitchell |
| 3,656,245 | A | | 4/1972 | Wilson | 36/67 D |
| 3,732,634 | A | | 5/1973 | Jacobson | 36/2.5 AH |
| 3,768,183 | A | | 10/1973 | Fessenden | 36/67 |
| 4,014,114 | A | | 3/1977 | Jordan et al. | 36/67 D |
| 4,146,979 | A | | 4/1979 | Fabbrie | 36/67 D |
| 4,160,331 | A | | 7/1979 | Bell | 36/59 |
| 4,286,396 | A | | 9/1981 | Deacon | 36/62 |
| 4,307,521 | A | | 12/1981 | Inohara et al. | 36/31 |
| 4,327,503 | A | | 5/1982 | Johnson | 36/32 R |
| 4,360,490 | A | | 11/1982 | Collins | 264/249 |
| 4,366,632 | A | | 1/1983 | Bente | 36/67 D |
| 4,378,643 | A | | 4/1983 | Johnson | 36/129 |
| 4,439,936 | A | | 4/1984 | Clarke et al. | 36/102 |
| 4,466,205 | A | | 8/1984 | Corbari | 36/134 |
| 4,561,197 | A | | 12/1985 | Misevich | 36/127 |
| 4,676,010 | A | | 6/1987 | Cheskin | 36/32 R |
| 4,698,924 | A | | 10/1987 | Greiner et al. | 36/134 |
| 4,702,021 | A | | 10/1987 | Cameron | 36/62 |
| 4,712,318 | A | | 12/1987 | Greiner et al. | 36/134 |
| 4,715,133 | A | | 12/1987 | Hartjes et al. | 36/127 |
| 4,723,366 | A | | 2/1988 | Hagger | 36/134 |
| 4,779,360 | A | | 10/1988 | Bible | 36/7.7 |
| 4,783,913 | A | | 11/1988 | Aoyama | 36/134 |
| 4,833,796 | A | | 5/1989 | Flemming | 36/134 |
| 4,885,851 | A | | 12/1989 | Peterson | 36/127 |
| D310,294 | S | | 9/1990 | Peterson | D2/317 |
| 5,027,532 | A | | 7/1991 | MacNeill et al. | 36/134 |
| 5,033,211 | A | | 7/1991 | Latraverse et al. | 36/134 |
| D321,977 | S | | 12/1991 | Kilgore et al. | D2/320 |
| D324,133 | S | | 2/1992 | Mitsui | D2/320 |
| D324,763 | S | | 3/1992 | Kayano | D2/320 |
| D325,815 | S | | 5/1992 | Bass | D2/320 |
| D327,975 | S | | 7/1992 | Saito et al. | D2/314 |
| 5,259,129 | A | | 11/1993 | Deacon et al. | 36/127 |
| 5,265,354 | A | | 11/1993 | Aliano, Jr. | 36/127 |
| 5,293,701 | A | | 3/1994 | Sullivan | 36/59 R |
| D347,934 | S | | 6/1994 | Mitsui et al. | D2/953 |
| D348,147 | S | | 6/1994 | Nakano | D2/960 |
| 5,367,793 | A | | 11/1994 | Deacon et al. | 36/127 |
| D356,672 | S | | 3/1995 | Ueda | D2/959 |
| 5,396,717 | A | | 3/1995 | Bell | 36/7.3 |
| 5,485,687 | A | | 1/1996 | Rohde | 36/62 |
| D368,157 | S | | 3/1996 | Erickson | D2/962 |
| D371,453 | S | | 7/1996 | Deacon et al. | D2/962 |
| 5,533,282 | A | | 7/1996 | Kataoka et al. | 36/129 |
| D372,354 | S | | 8/1996 | Mitsu et al. | D2/952 |
| D375,192 | S | | 11/1996 | Bathum | D2/962 |
| 5,732,484 | A | | 3/1998 | Grutza et al. | 36/127 |
| 5,832,636 | A | * | 11/1998 | Lyden et al. | 36/59 R |
| 5,901,472 | A | | 5/1999 | Adam | 36/134 |
| 5,906,059 | A | | 5/1999 | Singer et al. | 36/134 |
| 6,138,386 | A | * | 10/2000 | Singer et al. | 36/127 |

* cited by examiner

COMPOSITE CLEAT FOR ATHLETIC SHOE

This application is a continuation-in-part of U.S. application Ser. No. 09/235,581, filed on Jan. 22, 1999 which is a continuation-in-part of U.S. application Ser. No. 08/922,822; filed Sep. 3, 1997. Now U.S. Pat. No. 5,906,059.

BACKGROUND OF THE INVENTION

I. Field of the Invention

The present invention relates to a cleat or spike for an athletic shoe and particularly to a non-metal, composite cleat for a golf shoe constructed from two or more polymeric materials having different densities and/or hardnesses.

II. Background

Spikes or cleats for athletic shoes have long been used to provide traction in dirt and grass. Such spikes or cleats typically have been made of metal or other relatively hard materials.

Shoe cleats or spikes, particularly those that are removable or replaceable, have been known in the art for at least the last 80 years. Supplemental sole protectors that attach to a shoe have also been known for over 100 years.

As early as 1891, prior artisans recognized the need for a supplemental traction device that could be attached to the bottom of a shoe. In 1891, Lithgow received U.S. Pat. No. 461,103 for such a sole protector.

U.S. Pat. No. 1,237,451 to Baldwin, issued in 1817 for a supplemental traction device. Baldwin discloses on the front page of the patent, a cleat having a circular base and a plurality of transverse ribs that extend radially outward from a center stud or head. Baldwin describes the ribs as being useful for gripping the ground to enable a golfer to assume a,steady position while making a drive.

In 1918, Studer received French Patent No. 493,748 for a cleat having a circular base with a plurality of straight, radially extending ridges. The ridges of Studer project inwardly from the outer circumference to a raised central area. Moreover, Studer incorporated a threaded member on the cleat to screw into a shoe sole.

In 1940, U.S. Pat. No. 2,185,397 issued to Birchfield for an athletic shoe cleat. The cleat of this patent is circular and utilizes a collection of radially extending straight ribs having flat tops. The cleats may be formed of a hard rubber material.

U.S. Pat. No. 2,509,980 to McCallum, which issued in 1950, discloses a removable shoe cleat for use with golf shoes. The cleat has a circular or disk-like base. The cleat has a conical stud portion with a plurality of channels having rounded interiors. In addition, the cleat has three curved wings that radiate out from the center and which provide for the optimal gripping of surfaces. The cleat comprises a threaded member that screws into an aperture along the underside of a shoe.

U.S. Pat. No. 2,895,235 to Melchiona, issued in 1959, describes a removable spike for use on sport shoes, such as golf shoes. The spike has a circular base and externally projecting ribs radially extending from the boss or slightly raised center portion of the spike. The ribs have curved sides or edges. The spike, which is stamped from metal, has a threaded member that screws into an aperture on the bottom of a shoe.

In 1970, U.S. Patent No. 3,512,275 was issued to Leavitt for a "non-penetrating" cleat arrangement. As shown in the figures of this patent, the cleat arrangement utilizes a plurality of straight, (actually broken-line) radially extending flat top ridges.

More recently, various structures for cleats have been suggested including cleats having a metal or ceramic insert center surrounded by an elastomeric material. However, it was often found when using such cleats on athletic surfaces, particularly artificial turf, that the cleats of an athletic shoe would be subject to increased wear due to the harder insert supported by a relatively softer cleat body. U.S. Pat. No. 4,833,796, to Flemming discloses one example of such an arrangement. In this arrangement, a relatively stiff elastic cleat body holds a ceramic insert. In this manner, the ceramic portion, which is relatively very hard, makes contact with the playing surface, while the supporting elastic cleat body allows for flexibility and therefore less stressful dynamic loading of the athlete's foot.

Flemming's cleat, however, does not solve a problem often encountered by golfers. That is the need to walk not just over greens, but also over smooth hard surfaces peripheral to the playing area. Like traditional metal cleats, on a hard surface, the Flemming cleat provides little traction and also does not address the additional problems of scratching the surfaces that are walked on, which in some areas peripheral to a golf course is of some concern.

More recently, the golf cleat industry has focused on an alternative to the more commonly used metal golf spikes. The newer alternative spikes or cleats are typically formed from a non-turf penetrating, resilient polymeric material. These alternative cleats are often described as being "green-friendly" because of their non-turf penetrating nature. In addition to being "green-friendly", the alternative. cleats have been found to be easier on the human body compared to previously used metal cleats.

In Nov. 1993, U.S. Pat. No. 5,259,129 was issued to Deacon, et al. This patent is directed to an alternative golf cleat formed of a resilient plastic material which, according to Deacon, et al. "provides traction but does not damage the surface being walked upon."

Since 1993, a wide variety of utility and design patents have been issued by the U.S. Patent and Trademark Office which are directed to various alternative cleat configurations.

Clearly, from the foregoing sampling of prior art, it will be appreciated that removable shoe cleats or spikes, both metal and polymeric, are well known in the art, further, prior artisans have for many years, provided such cleats with a circular or disk-like base portion having a threaded member extending traversely therefrom. The threaded member screws into an aperture on the bottom of a shoe or boot.

However, in spite of the variety of alternative cleats now available, improvements in cleats for athletic shoes, and particularly for golf shoes, are still being sought.

SUMMARY OF THE INVENTION

The present invention provides a cleat comprising a stud with a composite body for an athletic shoe that provides traction both on hard and smooth surfaces and on greens in a relatively non-penetrating manner. In accordance with one aspect of the instant invention, an exchangeable cleat having a non-metal body is provided. The non-metal body is formed of a material having first durometer (or hardness) and has a central portion formed of a material having a second durometer (or hardness). The central portion preferably extends a short distance away from a disk of surrounding material having a different durometer than the central portion, allowing (in one embodiment) a gripping central area for walking on harder surfaces. The wider, surrounding cleat provides traction on the turf, for example, during a golf swing.

In further accordance with the invention, the removable cleat can be used year-round in golf without sacrificing performance and while providing damage avoidance to greens.

The invention also includes athletic shoes provided with a plurality of dual-density cleats. Preferably, the cleats have a body that is long wearing and slip resistant by utilizing polymers and/or plastics. The non-metal, central portion preferably extends only a short distance beyond a surrounding turf-gripping portion, and provides non-penetrating but effective traction, e.g., during a golf swing.

An additional embodiment includes a non-metal cleat having enhanced turf gripping properties which are imparted by a plurality of traction elements having arcuate ridges which grip or "bite" the turf during a golf swing.

A further embodiment of the invention provides for an abrasive material to be incorporated into or onto either or both of the material of a first durometer and material of a second durometer utilized in the non-metal body of the cleat.

In preferred embodiments of the invention, the materials are selected to provide a long wearing, slip-resistant, non-metal golf cleat that alleviates damage to the surface of a golf green, yet provides traction on grass and wears similar to conventional metal spikes.

These and other objects and features of the invention will be apparent from the following description and from the claims.

BRIEF DESCRIPTION OF THE DRAWINGS

The following is a brief description of the drawings which are presented for the purpose of illustrating the invention and not for the purposes of limiting the same.

DETAILED DESCRIPTION OF THE INVENTION

Figure 1:
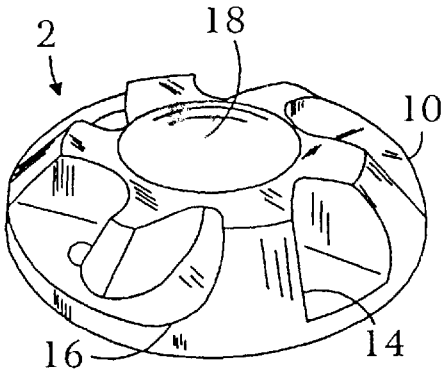
FIG. 1 is a perspective view of a cleat for athletic shoes in accordance with one embodiment of the present invention.
Figure 2:
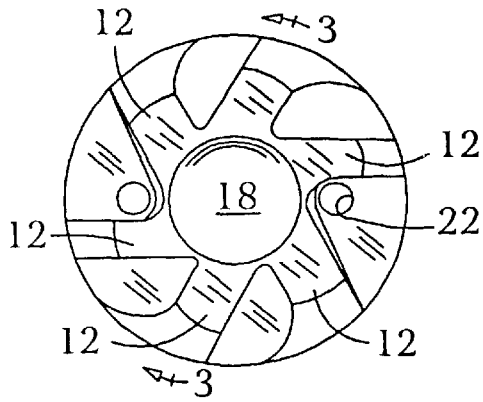
FIG. 2 top view of the cleat of FIG. 1.
Figure 3:
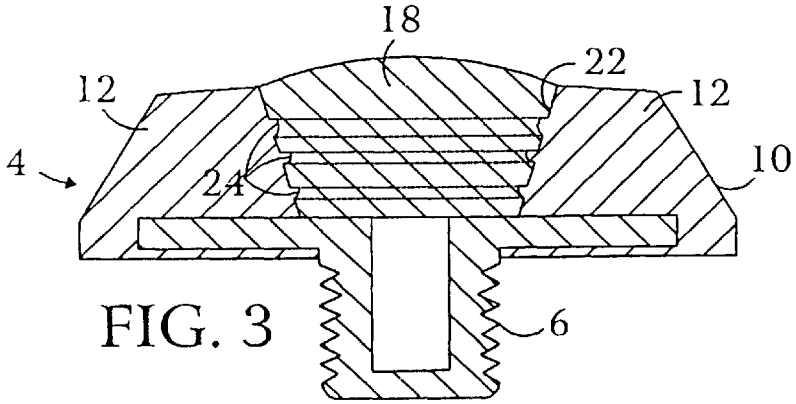
FIG. 3 is section view of a composite cleat taken along line 3—3 of FIG. 2.
Figure 4:
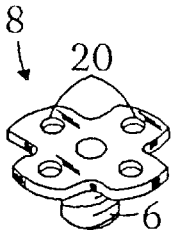
FIG. 4 is isomeric view of a cloverleaf stud base according to one illustrative embodiment of the invention.

Referring now to the drawings, wherein the showings are for the purposes of illustrating the preferred embodiments of the invention only and not for purposes of limiting same, a non-metal composite cleat 2 is illustrated in FIGS. 1–3. The cleat is held to the sole of an athletic shoe by an integral stud 4. As shown in the illustrative embodiment, stud 4 preferably comprises external mounting thread 6, allowing the stud 4 to be turned into one of several matingly threaded mounts in the sole of a shoe. A mounting tool engages the cleat body 2 at tool fittings 20 to allow the cleat to be firmly rotated into tight engagement within the internally threaded mount of the shoe.

Figure 5:
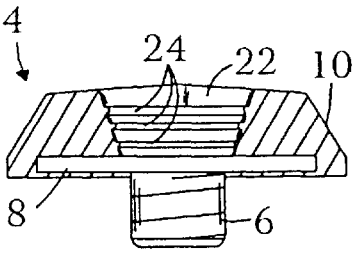
FIG. 5 is a cutaway view of a cloverleaf stud base and molded disk portion according to one illustrative embodiment of the invention.
Figure 6:
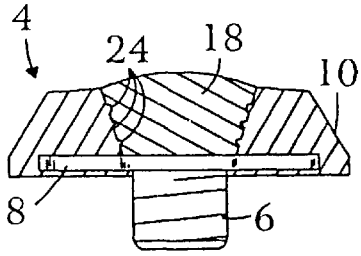
FIG. 6 is a cutaway view of a cleat for an athletic shoes according to one illustrative embodiment of the invention.

In an illustrative embodiment of the instant invention, the cleat is molded in two steps about a metal clover-shaped or "cloverleaf" base 8 as depicted in FIG. 3. In the first step, a disk portion 10 is molded about the base 8 to provide an intermediate component as depicted in FIG. 5. Disk 10 is shaped with a plurality of gripping sections 12, which are constructed and arranged to grip the turf, e.g., of a golf course during the player's swing, and prohibit slipping of the sole of the golf shoe. The disk portion preferably is also molded to form tool fittings so as to correspond to two of the holes 20 in the cloverleaves of base 8 surrounded by the wings 12. In a second molding step, a center portion 18, is formed preferably protruding from the upper major surface of the disk as depicted in FIG. 6. In use, the upper, or second, major surface is the ground-contacting surface. The frustoconical cavity 22 may further have ribs or threads 24 on the surface in order to aid in the retention of the center portion 18. As depicted, the frustoconical cavity 22 is convex to aid in the molding process, but can be concave or cylindrical. The relative geometric shapes of the disk portion 10 and the center portion 18 can have any mating shape, subject only to the desire of the designer and the ability to manufacture the part.

In another foreseen embodiment, the body of the cleat comprises a base which is attached to stud 4 and supports disk 10 at a major surface thereof. In this foreseen embodiment, the stud, base, and disk portions are formed integrally. As with this first illustrative embodiment, a center portion 18, preferably protruding from the upper major surface of the disk, is located within the disk.

In both of the aforementioned illustrative embodiments, the gripping sections 12 are raised from the base 8, and extend from the center portion 18 to the outer edge of the disk 10. In illustrative embodiment, the circumference of the disk 10 is shown to comprise a shoulder area, rendering the disk a horizontal frustoconical section. In the illustrative embodiment, a typical gripping section 12 and curves down toward the base 8 joining the straight side wall of an adjacent gripping section 12. Each gripping section extends outward from the center section 18 to the circumference of the disk.

Preferably, the gripping section has an edge formed by the top horizontal surface of the disk and the straight wall. The edge preferably extends from the center portion 18, along a tangent to the rounded center portion, to the outer diameter of the disk. In the region of the cleat in which the tool fittings are located, segments having two substantially straight walls can be located to facilitate access to and use of the tool fittings.

In the illustrative embodiment of FIGS. 1–8, the slightly higher, preferably rounded, center portion 18 is made of a material having a durometer (or hardness) which is different than the material used to make the disk. The different durometer of the center portion can provide slip resistance when walking on most hard, smooth, and/or dry surfaces.

In additional embodiments, the gripping sections 12 may be less than, greater than, or equivalent to the height of the center 18. Alternatively, the vertical protrusions may be a combination of varying heights.

Preferably, the durometer (or hardness) of the disk portion of the body is between about 60–67 on the Shore A scale (10 sec delay). More preferably the durometer is in the range of 55 to 75 on the Shore A scale (10 sec delay). The center portion preferably has a durometer of about 55–62 on the Shore A scale (10 sec delay). More preferably, the durometer is in the range of 49–65 on the Shore A scale (10 sec delay). The disk portion may be comprised of elastomers, plastics or other polymers and typically has a specific gravity of about 0.99 g/cc, more preferably in the range of 0.85–1.05 g/cc. The center portion may be comprised of elastomers, plastics or other polymers and typically has a specific gravity of about 0.95 g/cc, more preferably has a slip resistance equivalent to a better than 1.11/1.11 (dry/wet) on vinyl tile in accord with ASTM F-489, and an NBS abrasion index of about 175 or better. The disk portion is typically of a material having an NBS abrasion index of about 225 or better. In one embodiment, the material for the center portion is HP136X-60A footwear compound and the disk portion is HP100X-65A footwear compound, both purchased from UNIComp, Hampton, N.H. Another embodiment of the cleat consists of either of the center portion or disk portion of the cleat being formed from nitrile styrene butadiene rubber (NSBR). Alternatively, the above referenced materials may be reversed with respect to the disc and center portions.

A further embodiment of the invention provides for an abrasive material to be incorporated into or onto either or both of the material of a first durometer and material of a second durometer utilized in the non-metal body of the cleat. The materials which can be utilized as abrasive materials include, but are not limited to, silicon carbide, tungsten carbide, natural diamond, artificial diamond, aluminum oxide, or other substantially wear resistant compounds. Particles are sized and distributed either intimately within either or both of the materials utilized in forming the non-metal portions of the cleat or can be distributed along the ground engaging surface of the cleat.

In a further embodiment of the abrasive containing cleats, a plurality of cleats having different degrees of abrasiveness are provided. According to this embodiment, cleats with a higher degree of abrasiveness can be attached at portions of the sole of the shoe where increased anti-slip and increased ground gripping is desired. In this embodiment, different degrees of abrasiveness may be achieved by varying the size of the particles between different cleats, by varying the density of the particles used in the different cleats, by varying the types of materials used as abrasives in the cleats, or by varying the depth into which the particles are imbeded into the cleats.

In yet another alternative embodiment as represented in FIGS. 9–16, a cleat 40 is provided which has a clover leaf base 96 and a non-metal body 100. The clover leaf base 96 is joined to an integral stud 62 which may be matingly mounted to mounts or receptacles in the sole of a golf shoe.

Non-metal body 100 is comprised of a first component 41 which surrounds a second protruding center 48 and underlying component 54. The first component 41 is formed of a first material having a first durometer (or hardness) and the second center component 48 (which protrudes from the upper surface of the underlying component 54) and underlying component 54 are formed from a second material having a second durometer (or hardness).

Figure 15:
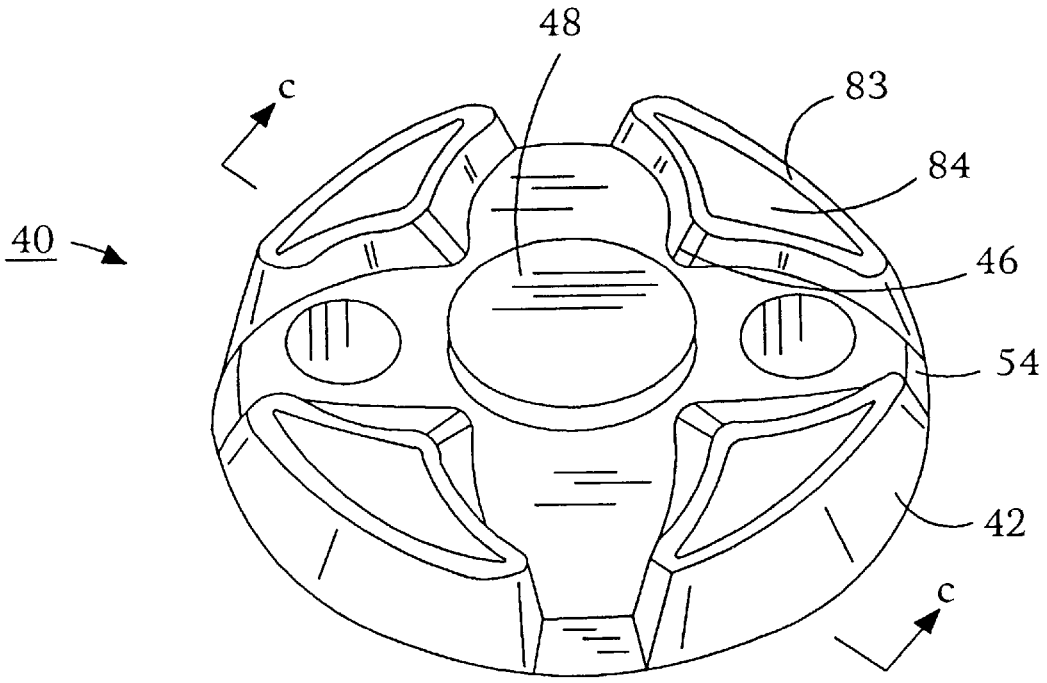
FIG. 15 is perspective view of a cleat of FIG. 9 having a portion of the cleat worn away.
Figure 17:
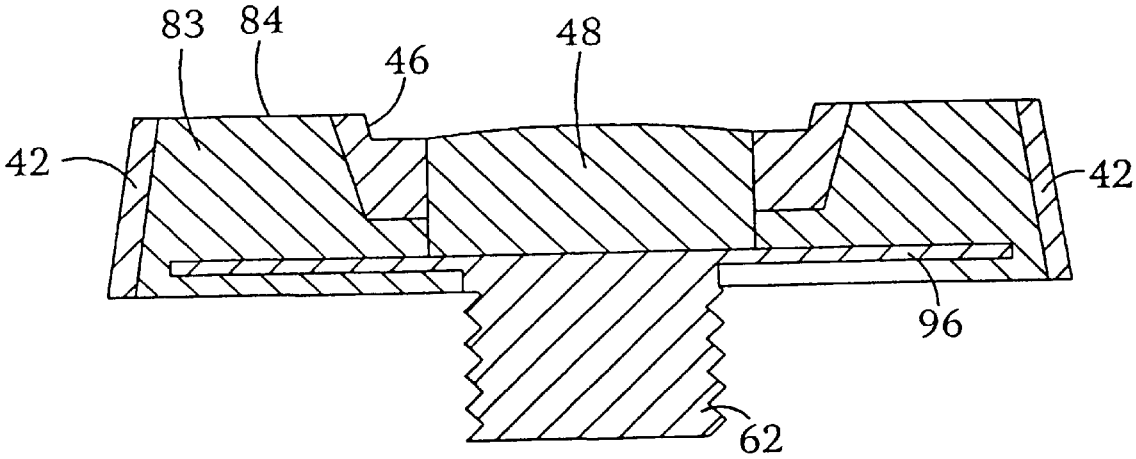
FIG. 17 is a cross-sectional view of the cleat of FIG. 15 along line C—C showing an alternative four part construction of the present invention.

Optionally, the center component 48 and the underlying component 54 may be formed of different materials having different durometers or hardnesses. In FIG. 17 a cleat cross-sectional view along line C—C of FIG. 15 depicts an embodiment where center component 48 is separate from underlying component 54.

In one embodiment, the first material may have a first durometer which is greater than the durometer of the second material. In an alternative embodiment, the first material may have a durometer which is less than the durometer of the second material. The first and second materials may be of different colors and/or compositions so that when the first material wears away the second material will noticeably show through (FIG. 15).

Figure 9:
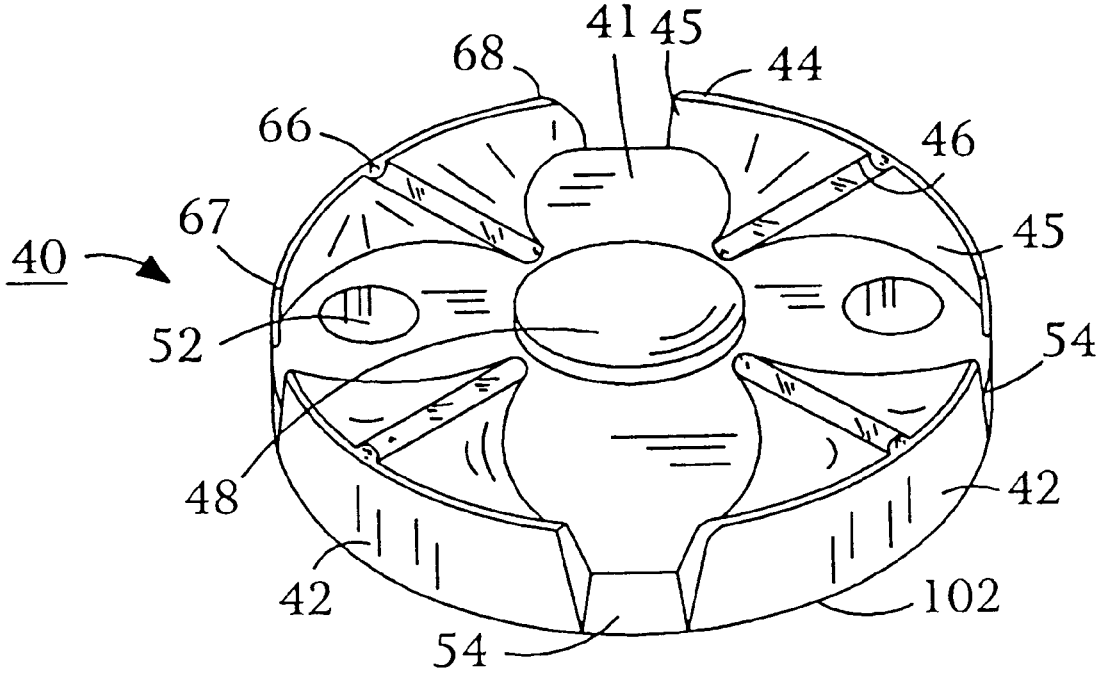
FIG. 9 is a perspective view of a cleat for athletic shoes in accordance with a further embodiment of the present invention.
Figure 10:
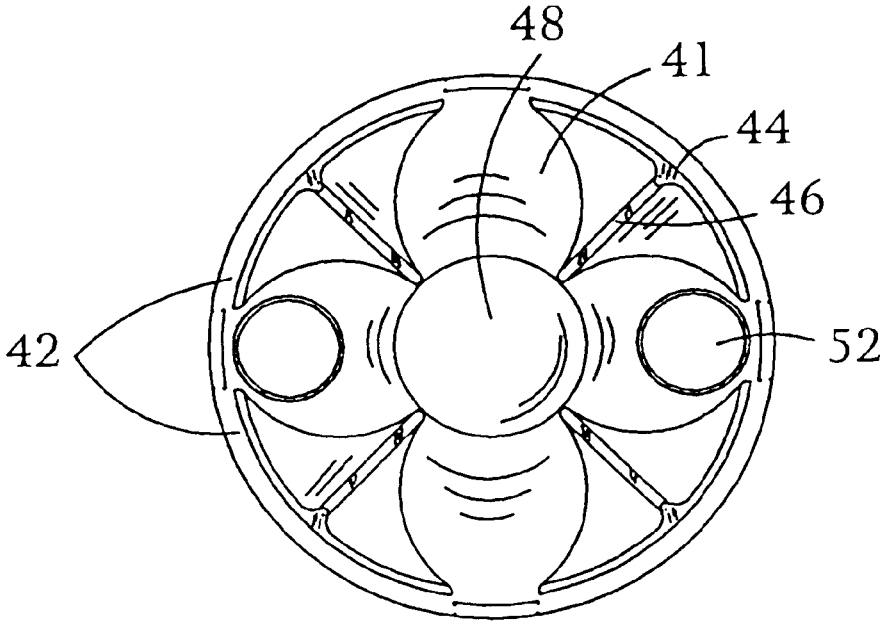
FIG. 10 is a top view of the cleat of FIG. 9.
Figure 14:
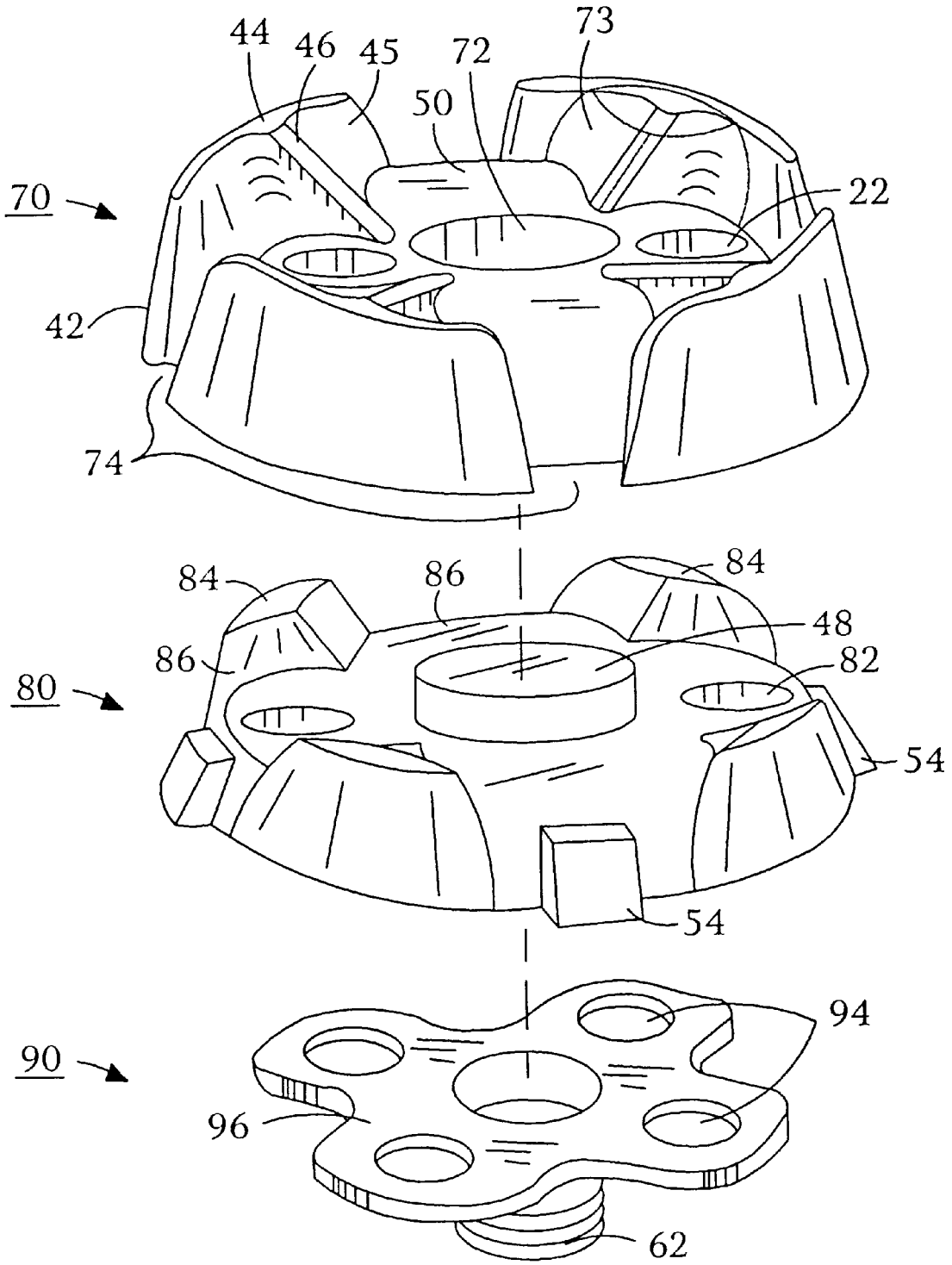
FIG. 14 is an exploded view of a three part alternative construction of a cleat of the present invention.

More particularly, FIGS. 9, 10 and 14 show an alternative cleat embodiment 40 according to the invention comprising a non-metal body 100 comprised of a first, outer component 41, 70 which surrounds a second central 48 and underlying component 54. The first and outer component 41 has traction gripping elements 42 which extend away from a shoe sole to form an outermost ground contacting surface 44.

The outermost ground contacting surface 44 consists of an arcuate rib which has a rounded end 68, a central portion 66 which is a greater distance from base 102 than as rounded end 68, and an angular end 67 at the opposing end of the arcuate rib which is equidistant from base 102 as rounded end 68 thereby imparting a slightly curved surface to the arcuate rib of traction element 42, the curved surface being curved away from the generally flat surface of the base 102 of the cleat. Each traction gripping element 42 has two gradual curved slopes 45 which curve inwardly and downwardly to a downwardly sloping rib 46. The downwardly sloping rib 46 extends toward the center portion of the cleat 48 from the center or middle of the ground contacting surface 44 of traction gripping element 42. The downwardly sloping rib element 46 has a generally flat surface, functioning as a turf grabbing element for the cleat. Apertures or tool fittings 52 are provided for insertion of a cleat installation/removal tool (not shown).

Figure 11:
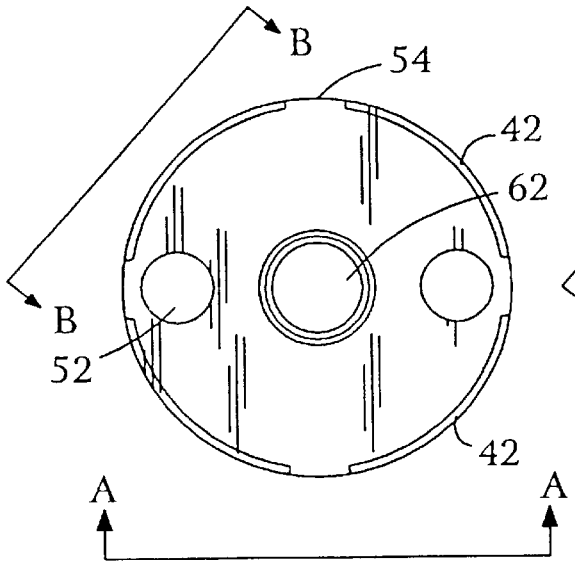
FIG. 11 and FIG. 11A are bottom views of the cleat of FIG. 9 wherein FIG. 11A has raised portions in an alternative embodiment for gripping the sole of a shoe.
Figure 11A:
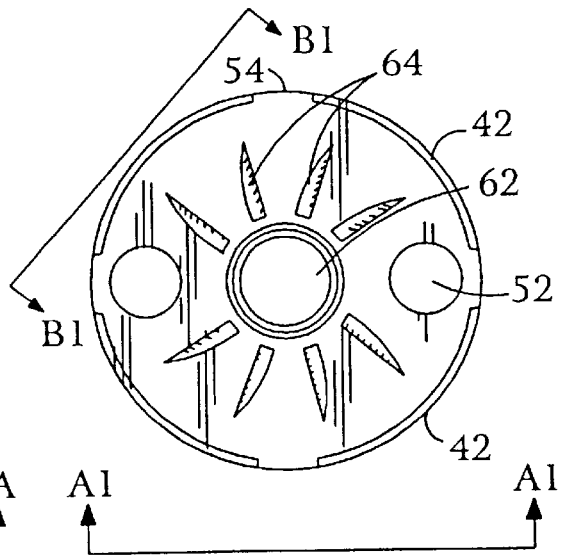

A bottom view of the cleat 40 is shown in FIG. 11 and an alternative bottom is shown in FIG. 11A. As seen in both FIG. 11 and FIG. 11A, a centrally located stud 62 is provided which may be a threaded stud as depicted in FIG. 11 and FIG. 11A. Raised portions 64 are present on the underside surface of base 102 to provide for frictional contact with the bottom of an athletic shoe into which the cleats are reversibly mounted or attached.

Figure 12:
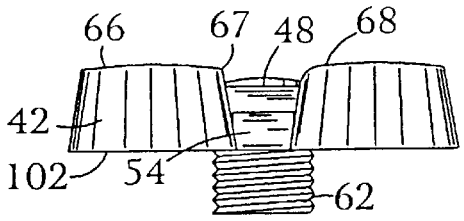
FIG. 12 and FIG. 12A are side views of the cleats of FIG. 11 and FIG. 11A.
Figure 12A:
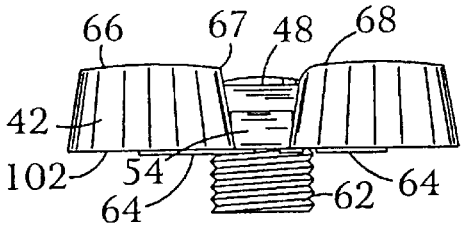
Figure 13:
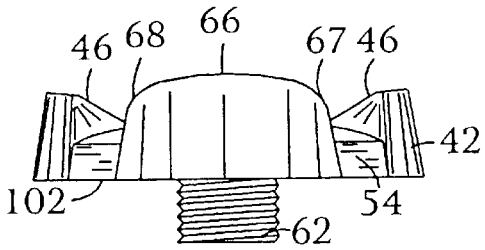
FIG. 13 and FIG. 13A are rotated views of the cleats of FIG. 12 and FIG. 12A.
Figure 13A:
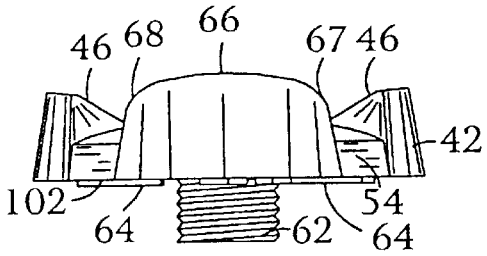

FIGS. 12 and 12A represent a side view of the cleat of FIG. 11 and FIG. 11A along view lines A—A and A1—A1. Similarly, FIGS. 13 and 13A represent a side view of the cleat of FIG. 11 and FIG. 11A along view lines B—B and B1—B1. As can be seen in each of FIGS. 12, 12A, 13, and 13A, traction gripping elements 42 have an arcuate shape with central portion 66 being a greater distance from base 102 than either rounded end portion 68 or angular end portion 67 imparting a curved surface thereto.

An exploded view of a cleat according to the invention is presented in FIG. 14 showing an upper or top, outer or ground contact surface portion 70, a central underlying portion 80 and a base or sole contact portion 90. The upper or top, outer portion 70 consists of the first component 41 and has an aperture 72 for receiving the protrusion 48 from the central, underlying portion 80, which may extend beyond the surface 50 of outer portion 70. Recessed areas 74 between traction elements 42 receive protrusions 54 from the central underlying portion 80. The top, outer or ground contact surface portion 70 has apertures 73 (shown in dotted lines) within each of traction elements 42 for receiving similarly shaped elements 83 extending away from the upper surface 86 of the central underlying portion 80. Additionally, the upper surface 84 of element 83 is slightly above the outer surface 50 of the top, outer portion of the cleat when placed within aperture 73.

Base element 90 is placed underneath central underlying portion 80 wherein two opposing apertures 94 align with apertures 82 and corresponding apertures 22 to form continuous holes in which a cleat installation/replacement tool can be used. Base portion 96 is then integrally molded within central, underlying portion 80.

FIG. 15 represents a worn version of the cleat 40 with central, underlying portion elements 83, 84 showing when the top portion of traction elements 42 are worn away. As indicated previously, by varying the color or composition of the top, outer portion 70 and central underlying portion 80, an indication of cleat wear is visible when the color or composition of element 83 begins to show through.

Figure 16:
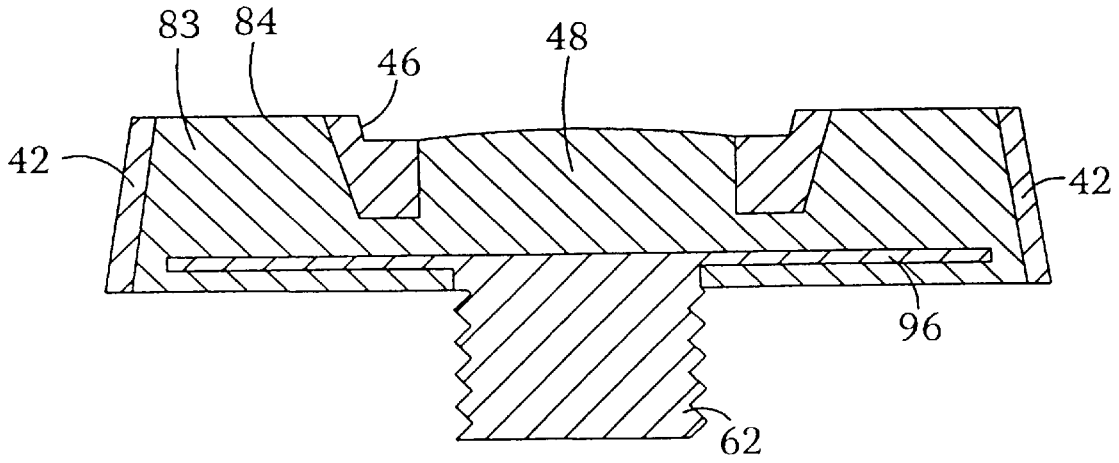
FIG. 16 is a cross-sectional view of the cleat of FIG. 15 along line C—C.

FIG. 16 represents a cross sectional view of the worn cleat of FIG. 15 along view line C—C.

In additional foreseen embodiments, the stud 62 can be metal and joined to the non-metal body by conventional means. The base 96 and the stud 62 can also be integral and formed of metal with the central underlying portion attached thereto by known joining methods, including mechanical fastening. Further, the stud 62 and/or base 96 can be made of the same material as the central underlying portion. Additional conventional fastening systems such as those described in U.S. Pat. Nos. 5,768,809, Des. 391,048 and Des. 388,949 can also be utilized in the present invention.

Figure 7:
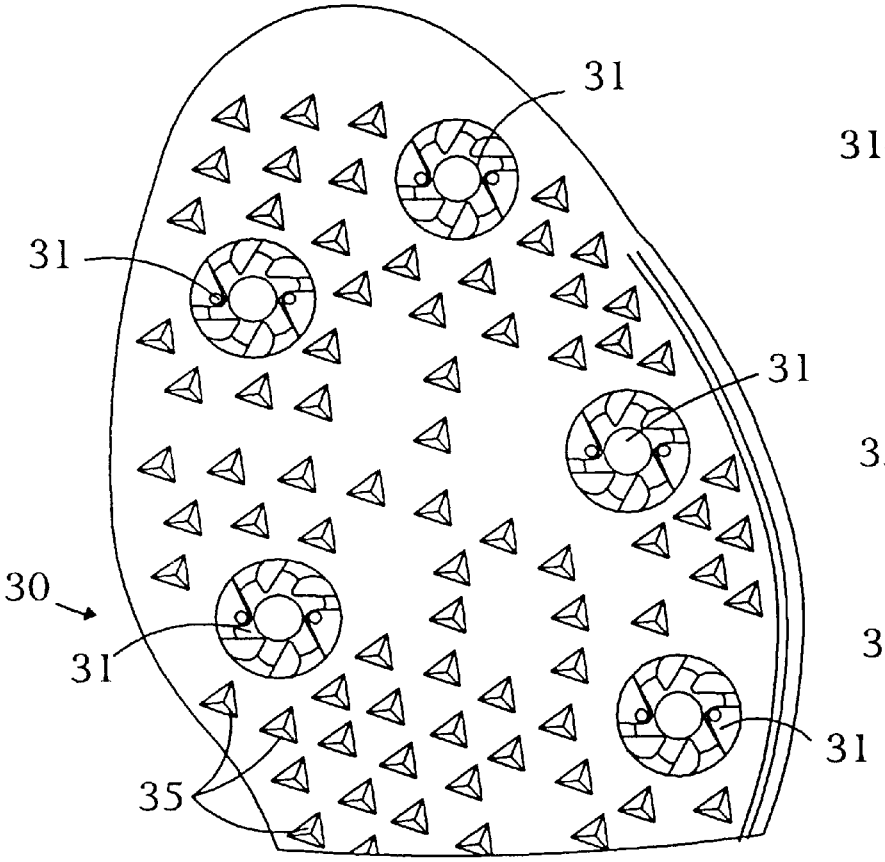
FIG. 7 if plan view of a sole of a shoe having mounting areas for receiving a plurality of cleats in accord with the present invention.
Figure 8:
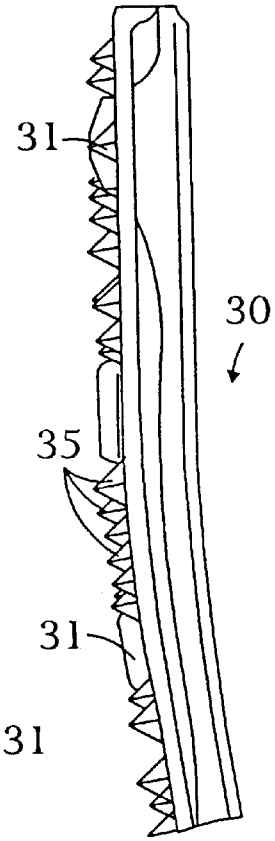
FIG. 8 is a side view illustrating one side of the sole of FIG. 7.

The invention also provides athletic shoes, such as golf shoes, having a plurality of cleats of the present invention mounted in the soles. As illustrated in FIGS. 7 and 8, in accord with the present invention, the sole of an athletic shoe is provided with a plurality mounting areas for the cleats. In the illustrated embodiment, the sole 30 is a molded sole having seven mounting areas 31 for cleats. More or less cleats can be used according to the specific application. Preferably, the sole also has a plurality of integrally molded nubs 35, which can have a variety of shapes. The nubs 35 provide additional stability. The mounting areas include an internally threaded socket or other appropriate receptacle for receiving the stud of the cleat. The sockets can be molded of the same material as the sole or can be parts of metal inserts molded into the sole by conventional techniques. Cleats as described hereinbefore and according to any one of FIGS. 1–6 and 9–17 may be releasably mounted in mounting area 31 of sole 30.

Although the invention has been shown and described in detail including the preferred embodiments thereof, upon consideration of the disclosure including the drawings, those skilled in the art may make various changes, additions and omissions in the form and detail thereof without departing from the spirit and scope of the invention, as set forth in the claims.

What is claimed is:

1. A composite cleat for an athletic shoe, said cleat comprising:

a stud having a longitudinal axis for mounting the cleat to the athletic shoe; and a non-metal body comprising two non-metal components attached to said stud;

wherein said non-metal body comprises a first component which substantially surrounds a second center component, the first component being formed of a disk of a first material having a first durometer mounted to said stud on a first major horizontal surface of said disk and the second center component being formed of a second material having a second durometer which is different than the durometer of the first material and extending from a second major horizontal surface of said disk, wherein said disk further comprises a plurality of vertical protrusions extending outwardly from said second center component to the circumference of said disk, said protrusions terminating in a longitudinal direction, further wherein either or both of said disk of a first material and said second center component contains abrasive particles.

2. The composite cleat of claim 1, wherein said plurality of vertical protrusions terminate in a longitudinal direction at a vertical height less than said second center material.

3. The composite cleat of claim 1, wherein said plurality of vertical protrusion terminate in a longitudinal direction at a vertical height greater than said second center material.

4. The composite cleat of claim 1, wherein said second center component has a circular cross-section.

5. The composite cleat of claim 4, wherein said protrusions comprise a first edge defined by a chord extending tangentially from the circumference of said second center component to the circumference of said disk.

6. The composite cleat of claim 1, wherein the disk of a first material contains abrasive particles which are silicon carbide.

7. The composite cleat of claim 1, wherein the second center component contains abrasive particles which are silicon carbide.

8. The composite cleat of claim 1, wherein the disk of a first material and said second center component contain abrasive particles which are silicon carbide.

9. The composite cleat of claim 1, wherein the disk of a first material is formed from nitrile styrene butadiene rubber.

10. The composite cleat of claim 1, wherein the second center component is formed from nitrile styrene butadiene rubber.

11. An athletic shoe comprising a sole having a plurality of cleats mounted thereon, each cleat comprising:

a stud having a longitudinal axis for mounting the cleat to the athletic shoe: and;

a non-metal body comprising two non-metal components attached to said stud;

wherein a first component substantially surrounds a second center component, the first component being formed of a disk of a first material having a first durometer mounted to said stud on a first major horizontal surface of said disk and said second center component being formed of a second material having a second durometer which is different than the durometer of the first material and extending from a second major horizontal surface of said disk, wherein said disk further comprises a plurality of vertical protrusions extending outwardly from said second center component to the circumference of said disk, said protrusions terminating in a longitudinal direction, further wherein either or both of said disk of a first material and said second center component contains abrasive particles.

12. The composite cleat of claim 11, wherein said plurality of vertical protrusions terminate in a longitudinal direction at a vertical height less than said second center material.

13. The composite cleat of claim 11, wherein said plurality of vertical protrusion terminate in a longitudinal direction at a vertical height greater than said second center material.

14. The composite cleat of claim 11, wherein said second center component has a circular cross-section.

15. The composite cleat of claim 14, wherein said protrusions comprise a first edge defined by a chord extending tangentially from the circumference of said second center component to the circumference of said disk.

16. The composite cleat of claim 11, wherein the disk of a first material contains abrasive particles which are silicon carbide.

17. The composite cleat of claim 11, wherein the second center component contains abrasive particles which are silicon carbide.

18. The composite cleat of claim 11, wherein the disk of a first material and said second center component contain abrasive particles which are silicon carbide.

19. The composite cleat of claim 11, wherein the disk of a first material is formed from nitrile styrene butadiene rubber.

20. The composite cleat of claim 11, wherein the second center component is formed from nitrile styrene butadiene rubber.

21. The shoe of claim 11, wherein the sole further comprises a plurality of integrally molded nubs.

22. A composite cleat for an athletic shoe, said cleat comprising:

a stud having a longitudinal axis for mounting the cleat to the athletic shoe; and a non-metal body comprising two non-metal components attached to said stud;

wherein said non-metal body comprises a first component which substantially surrounds a second center component, the first component being formed of a disk of a first material having a first durometer mounted to said stud on a first major horizontal surface of said disk and the second center component being formed of a second material having a second durometer which is different than the durometer of the first material and extending from a second major horizontal surface of said disk, wherein said disk further comprises a plurality of vertical protrusions extending outwardly from said second center component to the circumference of said disk, said protrusions terminating in a longitudinal direction, further wherein either of said disk of a first material or said second center component is formed from nitrile styrene butadiene rubber.

* * * * *